US008487754B2

(12) United States Patent
Mitschele

(10) Patent No.: US 8,487,754 B2
(45) Date of Patent: Jul. 16, 2013

(54) PARKING ENFORCEMENT SYSTEM AND METHOD USING WIRELESS IN-GROUND SENSORS

(76) Inventor: Frederick L. Mitschele, Vancouver (CA)

( * ) Notice: Subject to any disclaimer, the term of this patent is extended or adjusted under 35 U.S.C. 154(b) by 712 days.

(21) Appl. No.: 12/529,147

(22) PCT Filed: Feb. 20, 2008

(86) PCT No.: PCT/CA2008/000338

§ 371 (c)(1),
(2), (4) Date: Oct. 1, 2009

(87) PCT Pub. No.: WO2008/104053

PCT Pub. Date: Sep. 4, 2008

(65) Prior Publication Data

US 2010/0117820 A1 May 13, 2010

Related U.S. Application Data

(60) Provisional application No. 60/892,234, filed on Feb. 28, 2007.

(51) Int. Cl.
*G08B 1/08* (2006.01)

(52) U.S. Cl.
USPC ..... 340/539.1; 340/426.1; 340/953

(58) Field of Classification Search
USPC ..... 340/539.1, 426.1, 932.2, 953, 539.11, 340/539.22, 539.26
See application file for complete search history.

(56) References Cited

U.S. PATENT DOCUMENTS

| | | | | |
|---|---|---|---|---|
| 5,714,754 | A * | 2/1998 | Nicholas | 250/221 |
| 5,940,014 | A * | 8/1999 | Hartt | 340/953 |
| 7,714,742 | B1 * | 5/2010 | Noworolski et al. | 340/932.2 |
| 2002/0111768 | A1 * | 8/2002 | Ghorayeb et al. | 702/178 |
| 2006/0152349 | A1 * | 7/2006 | Ratnakar | 340/426.1 |
| 2011/0099126 | A1 * | 4/2011 | Belani et al. | 705/418 |

* cited by examiner

*Primary Examiner* — Daniel Previl
(74) *Attorney, Agent, or Firm* — Cameron IP

(57) ABSTRACT

A vehicle parking control and enforcement system for a plurality of unmetered parking spaces is provided wherein in-ground vehicle sensors are coupled with a microcontroller or microprocessor to detect the presence or absence of a vehicle in a parking space, determine whether the vehicle is in violation of the parking regulations and communicate a violation to a parking authority. The in-ground vehicle sensors may also include a digital camera.

13 Claims, 6 Drawing Sheets

PARKING ENFORCEMENT SYSTEM AND METHOD USING WIRELESS IN-GROUND SENSORS

TECHNICAL FIELD

The present invention relates to vehicle parking enforcement systems and, more particularly, vehicle parking enforcement systems other than pay parking systems.

BACKGROUND ART

Currently, municipalities have a great number of locations on municipal streets where parking is either prohibited or restricted permanently and/or to particular times. For example, parking of vehicles will be prohibited in bus stop zones, red or yellow zones and in the vicinity of fire hydrants. On some busy streets, parking will be prohibited during rush hours but not otherwise. Similarly in private parking lots, parking spots may be reserved for specific individuals only or for customers of specific businesses. In addition, parking time limits may be enforced for these customers to prevent abuse and create turnover. To date there has been no automated way to enforce violations of these parking regulations. In order to enforce municipal parking violations, parking by-law enforcement officers patrol the streets on foot or in vehicles and issue parking tickets and summon tow truck operators. Similarly for private parking lots, operators physically monitor use of their parking spaces and may also issue private parking tickets and summon tow truck operators to tow vehicles or alternatively immobilize the vehicles. Typically, comparatively few enforcement officers are charged with responsibility for a large area and number of parking violators, so enforcement is random and uneven.

In-ground vehicle sensors are widely used to control stoplights and thereby assist in more efficient vehicular traffic. An example of such as in-ground sensor is the GROUND-HOG™ manufactured by Nu-metrics which is a wireless, self-contained, in-ground traffic monitor which transmits a wireless signal upon detection of a vehicle. The use of in-ground sensors in connection with an improved parking meter system is disclosed in the present inventor's International application no. PCT/CA206/001372 filed Aug. 21, 2006 which is pending and which is incorporated herein by reference. However the benefits of in-ground sensors have not to date been fully taken advantage of for vehicle parking enforcement where pay parking is not offered. In addition, the benefits of in-ground sensors have not to date been fully taken advantage of for the assistance of traffic management.

DISCLOSURE OF INVENTION

According to the present invention there is provided a vehicle parking enforcement system wherein in-ground vehicle sensors are coupled with a microcontroller or microprocessor to detect the presence or absence of a vehicle in a parking space, determine whether the vehicle is in violation of the parking regulations and communicate a violation to a central location. The in-ground vehicle sensors may also include a digital camera.

The invention therefore provides a method of vehicle parking control and enforcement in respect of a plurality of unmetered parking spaces, the method comprising: a) providing a plurality of in-ground sensors in spaced in-ground locations in the umetered parking spaces, each in-ground sensor associated with a related parking space and comprising a vehicle sensing element, a microprocessor, a clock and a timer coupled with and controlled by the microprocessor, a memory communicating with the microprocessor and containing parking information respecting the related parking space, and wireless communication means coupled to the microprocessor; b) upon one of the vehicle sensors sensing the presence of a vehicle in a parking space, communicating the presence of a vehicle in the related parking space to said microprocessor; c) the microprocessor starting the timing of a parking period for the related parking space based on said parking rules; d) if the parking information provides that the related parking space is a no-parking space at the time the vehicle was sensed, wirelessly communicating a violation signal to a parking authority if the vehicle is still sensed in the related parking space after a pre-determined standby interval from when the vehicle was sensed; e) if the parking information provide that the related parking space is a time-limited parking space for a specified duration at the time said vehicle was sensed, continuing to time the elapsed parking time until the microprocessor receives a signal from the vehicle sensor that the vehicle has left the related parking space, or until the specified duration has expired; and f) if the vehicle is still in the related parking space after the specified duration has expired, wirelessly communicating a violation signal to a parking authority.

The invention therefore further provides a method of vehicle parking control and enforcement in respect of a plurality of unmetered parking spaces, the method comprising: a) providing a plurality of in-ground sensors in spaced in-ground locations in the umetered parking spaces, each in-ground sensor associated with a related parking space and comprising a vehicle sensing element, a microprocessor, a clock and a timer coupled with and controlled by the microprocessor, a memory communicating with the microprocessor and containing parking information respecting the related parking space, namely the electronic identification of the vehicle authorized to park in the related space and wireless communication means coupled to the microprocessor; b) providing each vehicle authorized to park in one of the related parking spaces with an electronic tag readable by the in-ground sensor and containing the electronic identification; c) one of the vehicle sensors sensing the presence of a vehicle in a parking space, the in-ground sensor detecting the electronic identification of the vehicle and comparing the electronic identification of the vehicle to the parking information stored in the memory; and d) if the electronic identification of the vehicle differs from the parking information stored in the memory, or said vehicle has no electronic identification, wirelessly communicating a violation signal to a parking authority.

The invention therefore further provides a system for vehicle parking control and enforcement in respect of a plurality of unmetered parking spaces which carries ut the foregoing methods.

BRIEF DESCRIPTION OF DRAWINGS

These and other features of the invention will become more apparent from the following description in which reference is made to the appended drawings, wherein.

BEST MODE(S) FOR CARRYING OUT THE INVENTION

Figure 1A:
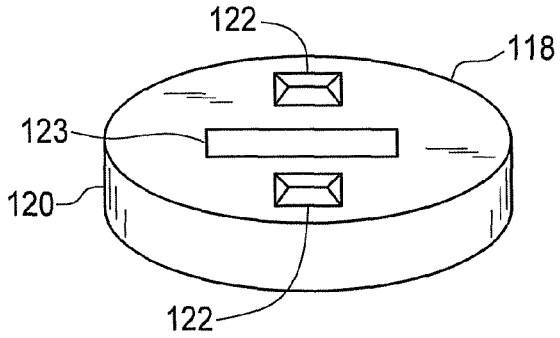
FIGS. 1A-1D are perspective views of wireless in-ground sensors.
Figure 1B:
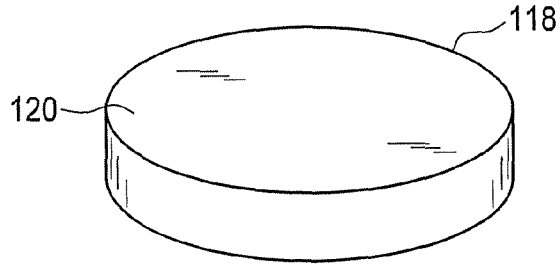
Figure 1C:
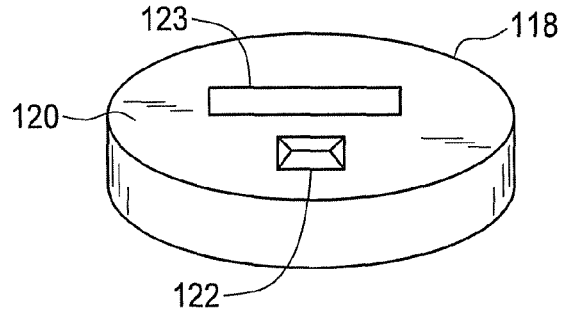
Figure 1D:
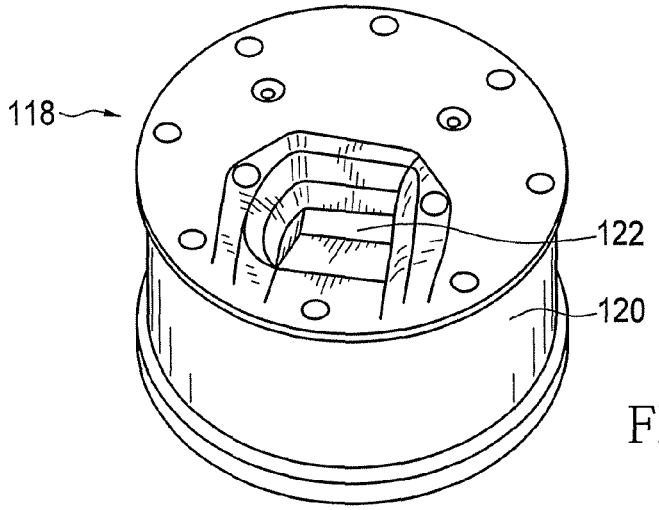
Figure 2:
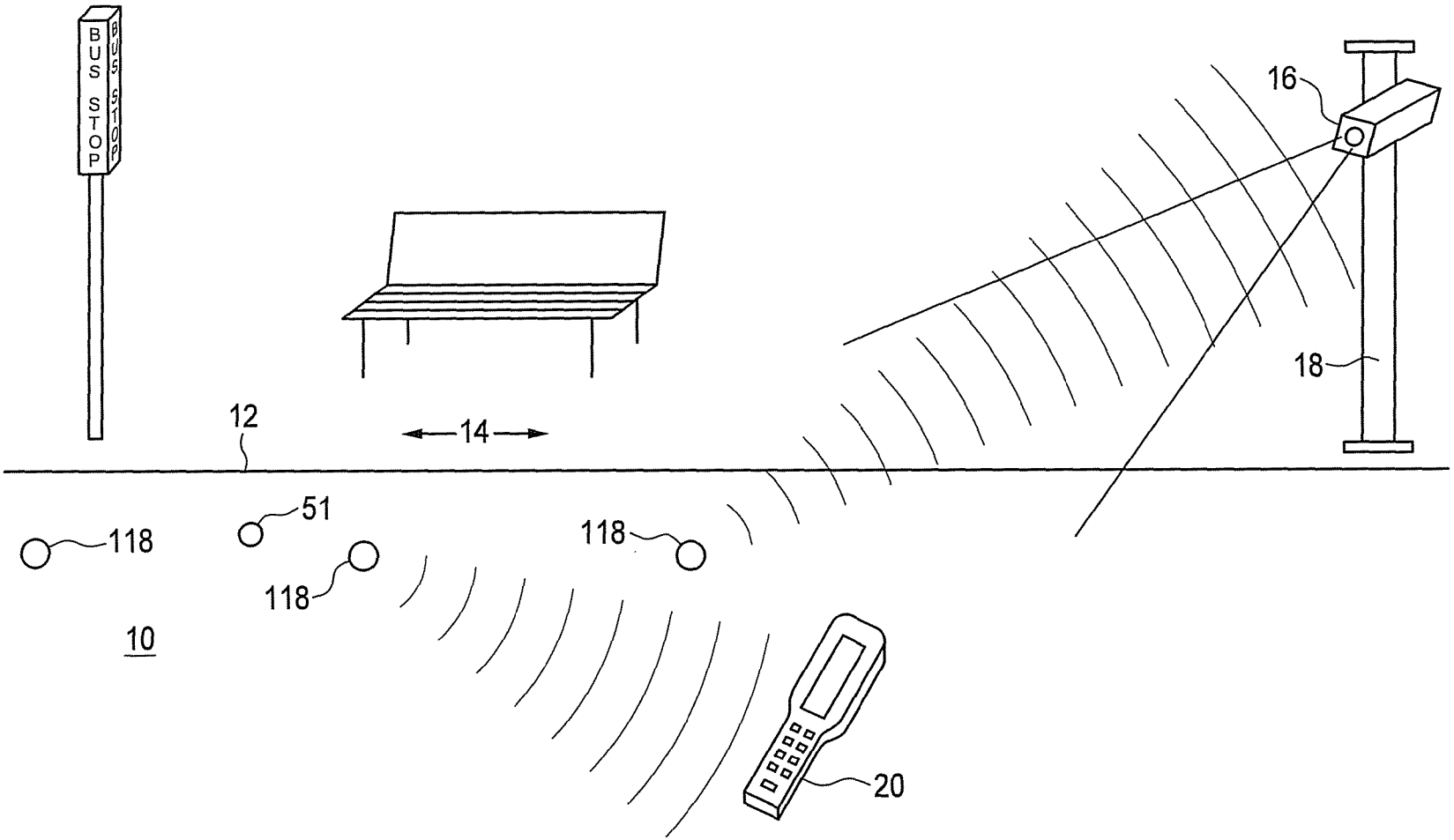
FIG. 2 is a perspective view of a municipal street with a no-parking bus stop area using multiple in-ground sensors to detect the presence or absence of vehicles and if they are in violation.
Figure 3:
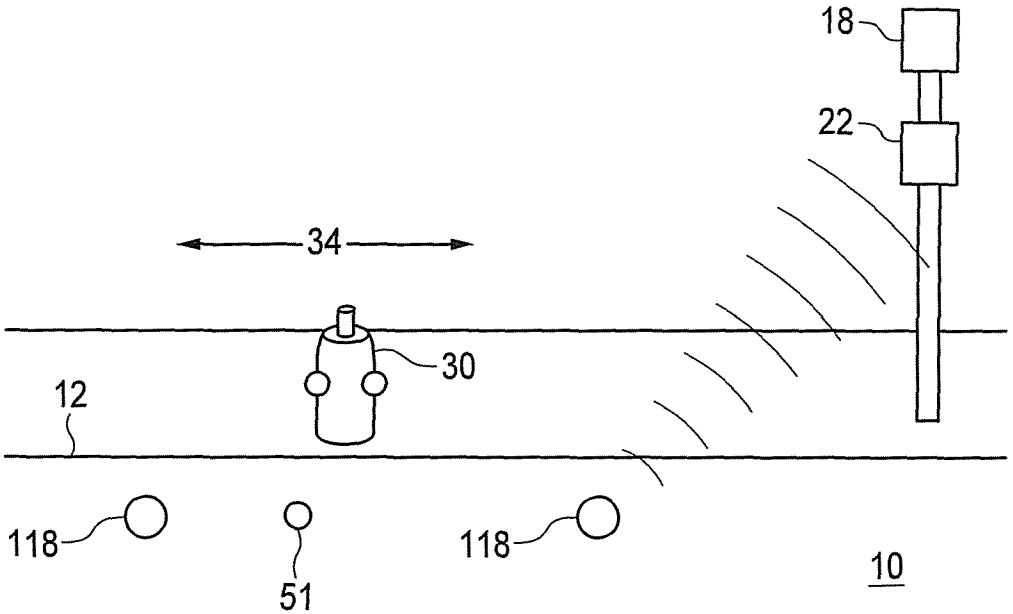
FIG. 3 is a perspective view of a municipal street with a no-parking fire hydrant area using multiple in-ground sensors to detect the presence or absence of vehicles.

Referring to FIG. 2, municipal street 10 has curb 12 and a no-stopping bus stop zone 14. Embedded in the asphalt in street 10 in the vicinity of no-stopping zone 14 are a number of in-ground vehicle sensors 118 (FIGS. 1A-D). Associated with each no-stopping zone 14 is a camera 16 mounted on pole 18. An in-ground camera mounted on in-ground sensor 118 or as a separate unit 51 can be provided in addition or instead of the pole-mounted camera 16. A similar arrangement is shown in FIG. 3 where the no-parking zone 34 is in the vicinity of fire hydrant 30.

In-ground vehicle sensors 118 may have a number of functionalities enclosed in housing 120. The vehicle sensing element of such sensors may be of the type manufactured by Honeywell, Nu-metrics, magnetic or proximity sensors. They may incorporate a microcontroller or microprocessor (referred to herein as the "microprocessor"), a clock to provide the date and time and a timer coupled with and controlled by the microprocessor, a memory communicating with the microprocessor, as well as the vehicle sensing circuit and wireless communication means all coupled to the microprocessor. A solar panel may be provided to provide power and/or charge a battery and a GPS unit may be provided to provide the geographic location of the device. The memory on the device will also store the parking regulations for that location and store any violations. The parking regulations (i.e. whether no stopping and/or no parking is permitted, limited time parking, parking only during certain hours etc.) can be stored in permanent memory for a particular in-ground unit or can be rewritten by the microprocessor, such as on receipt of a wireless instruction from the central parking authority. In-ground sensor 118 may be simply a vehicle detector without camera, as in FIG. 1B. It may include a single digital camera 122 as in FIGS. 1C and 1D for taking pictures of a vehicle in one stall, or may include two digital cameras as in FIG. 1A for taking pictures of vehicles in two adjoining stalls. It may also include an infrared light 123 for taking nighttime photos.

Referring to FIG. 2, the parking violation enforcement operation is initiated when a vehicle stops in no-stopping zone 14 and its presence is detected by in-ground vehicle sensors 118. The microprocessor initiates the timer for a predetermined standby interval upon receiving a signal from vehicle sensors 118 that a vehicle is present in no-stopping zone 14. A parking violation occurs when the vehicle is still detected in the no-stopping zone after a pre-determined interval expires, for example 30 seconds. Where the zone is a no-parking zone 34 as in FIG. 3, the interval may be longer, for example 3 minutes. Upon a parking violation, the microprocessor transmits a signal, preferably wirelessly via cellular network, WIFI, or Bluetooth, to camera 16, or a standalone in-ground camera 51, or a camera 122 of an adjoining sensor 118. Upon activation the digital camera 16, 51 or 122 which is associated with the no-stopping zone 14 takes a digital image of the license plate of the vehicle to obtain the license number. Camera 16, 51 or 122 may be an infrared camera to function in low light situations. The picture of the vehicle license plate is transmitted along with the date, time and violation data to a controller/server and then to the central station to prepare a violation ticket which is sent in the mail to the owner of the vehicle. Where combination sensors and cameras are used, then the in-ground sensor 118 which has detected the violation may communicate with the adjacent in-ground sensor 118 to take a photo of the licence plate of the violating vehicle. If both adjacent sensors 118 are covered by vehicles, the capture of the photograph can be deferred until a vehicle has left from the adjacent spot.

Alternatively the in-ground sensors 118 can communicate to a hand-held unit 20 of the type disclosed in the present inventor's patent application no. PCT/CA2005/000985, publication no. WO2006/000089, published Jan. 5, 2006, which is incorporated herein by reference. The enforcement officer with handheld unit 20 determines the location of the violation and uses the hand-held unit to take a digital image of the vehicle licence plate, or retrieves the original picture taken from camera 16, 51 or 122 either from a central server or from the sensor 118 or camera 51. If the vehicle is provided with an RFID identification tag, an RFID reader in the handheld unit or in-ground sensor 118 or camera 51 can interrogate the tag, which emits a coded reply signal which communicates a vehicle identification code to the interrogating source which decodes it and either the identification number is stored with the violation information for later processing and/or a call is initiated through a communications modem notifying parking authorities at a monitoring station as to a parking violation and providing the vehicle identification number. In either case a parking ticket is prepared, preferably with the digital image of the vehicle license and either placed on the vehicle, mailed to the registered owner of the vehicle, and a towtruck can be summoned if the vehicle needs to be moved or cleared.

Figure 4:
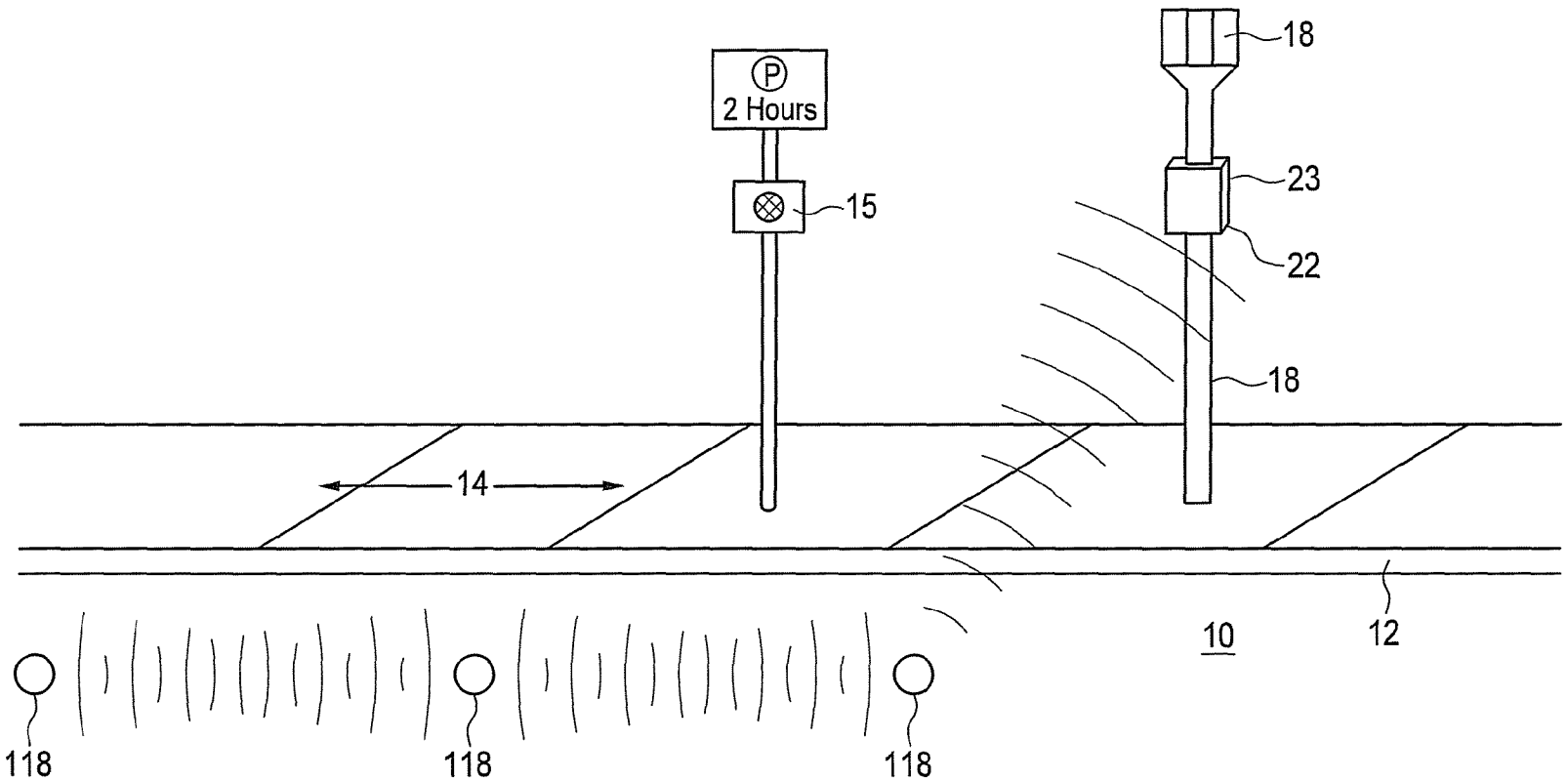
FIG. 4 is a perspective view of a municipal street with a no-parking area, or an area in which parking is free but is limited to a certain time limit, using multiple in-ground sensors to detect the presence or absence of vehicles and which communicate with a single local access point.

Referring to FIG. 4, a municipal street 10 has a no-parking area 14, or an area in which parking is free but is limited to a certain time limit, using multiple in-ground sensors 118 to detect the presence or absence of vehicles and which communicate with a single local access point 22. The system operates similarly for municipal streets where there is a no-parking period during rush hour, or parking for a stated maximum time. Such action would occur if the vehicle has parked during a no-parking period (rush hour), or in excess of a stated maximum time. In that case the in-ground sensor 118 will sense the presence of the vehicle, initiate a timer and upon sensing the continued vehicle presence after a certain elapsed time, signals a camera 16, 51 or 122 or hand-held unit 20 which will issue a parking violation and license image capture. Alternatively or in addition the microprocessor of unit 118 could cause a wireless signal to be sent to the towing company, for example by server to a hand-held unit in a tow truck, to signal that the vehicle can be immediately towed, or a flashing light 15 could be illuminated to indicate the violation. As shown in FIG. 4, in-ground sensors 118 can communicate also with each other via a "mesh network" and then to an access point 22 in housing 23 on light pole 18, which communicates over a cellular network or the internet to a central station. In this way each sensor 118 communicates with the next nearest sensor along the line until the access point 22 is reached, which then communicates to the central server. Alternatively each sensor 118 can independently communicate by WiFi or cellular network back to the central server.

Figure 5:
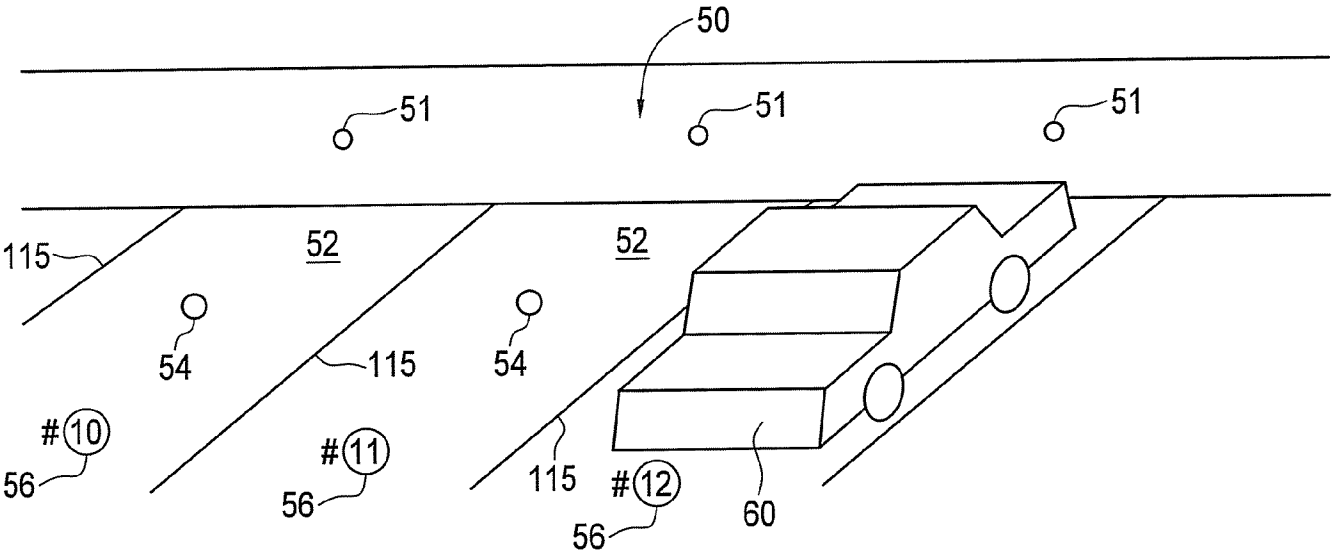
FIG. 5 is a perspective view of a private reserved parking area using multiple in-ground sensors to detect the presence or absence of vehicles.
Figure 5A:
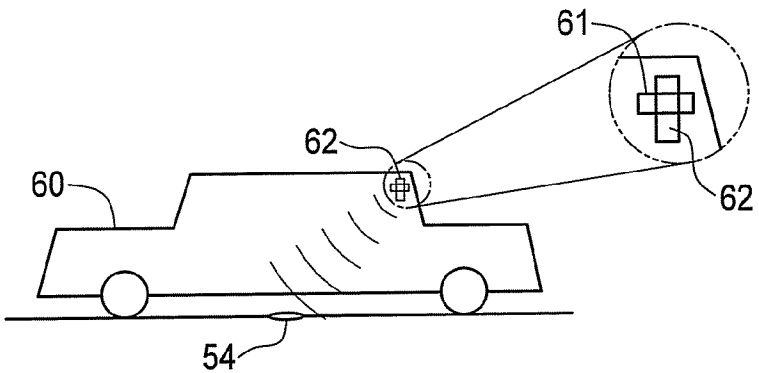
Figure 6:
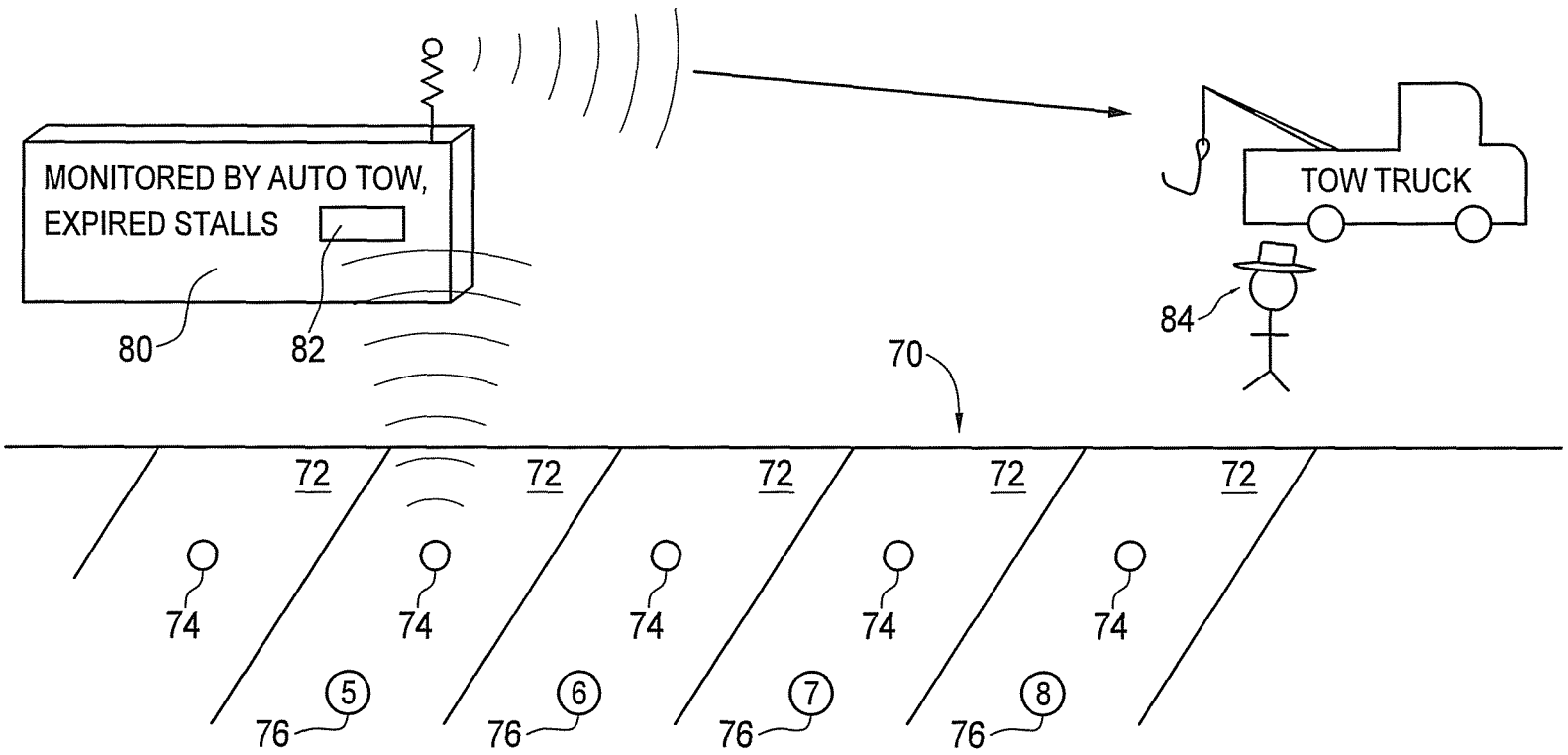
FIG. 6 is a perspective view of a private reserved parking area using multiple in-ground sensors to detect the presence or absence of vehicles with a parking display sign, and timing how long vehicles are permitted to park with a sign indicating the parking spaces which are in violation.

FIGS. 5 and 6 illustrate the system applied to private parking lots. A parking lot or garage 50 has a plurality of marked, reserved parking spaces 52, separated by dividing lines 115, each with an in-ground vehicle sensor 54, as described above for sensors 118. Each space or stall 52 is marked with a unique number 56. Vehicle 60 which has paid for a reserved parking space 52 is provided an electronic tag 62, which may be attached to the vehicle's rear-view mirror 61. When a vehicle parks in stall 52, in-ground sensor 54 checks via a reader for the associated electronic tag 62. If the tag ID matches the ID stored in the sensor 54 for the stall in question then no action is taken. The sensor may have a list of a number of authorized IDs that are authorized to park in that stall 52. If there is no vehicle ID or it does not match the correct ID then the sensor 54 issues a wireless signal to a tow truck operator or enforcement officer to ticket and/or tow the vehicle. Wireless communication can be via wilan, wifi, Bluetooth, gsm/gprs or other wireless protocol, and the units are addressable with an IP address.

Alternatively an in-ground sensor 54 with a digital camera, or a separate in-ground or wall-mounted camera 51 can be signalled to take a photo of the offending licence plate, or a mobile camera on the lot can be moved to focus on the violating stall. Since more than one valid electronic tag 62 may be within range of the sensor 54, to avoid multiple tags providing an authorized signal to the sensor, preferably after a tag has been verified to a stall it is "turned off" until it leaves the range of the inquiring signal from sensor 54. Where a number of monthly parkers are authorized to use a number of designated stalls 52, the sensor 54 for each such stall 52 may have a list of a number of authorized IDs that are authorized to park in that stall 52 and when a tag has been verified to a given stall it is "turned off" until it leaves the range of the inquiring signal from sensor 54 so that it does not permit unauthorized parking in adjacent stalls.

Referring to FIG. 6, in this case a private parking lot 70 or garage has a plurality of numbered parking spaces 72, each with an in-ground vehicle sensor and camera 74 as in sensors 118 described above. Each space or stall 72 is marked with a unique number 76. In this embodiment, customers are permitted to park in designated spaces 72 for a specified duration. When a vehicle pulls into a parking space 72 its presence is detected by vehicle detector 74. The microprocessor initiates the timer in respect of that numbered stall for the predetermined interval. Once the parking interval expires, the microprocessor communicates to a central processor 80 that the time has expired and the number of the violating stall is displayed on display 82. That will serve as a disincentive for patrons to overstay their parking period, and a towtruck operator 84 can also periodically tow vehicles which are in violation. The notice of violation can also be sent to a central server, hand-held unit with an enforcement officer or a digital photo of the offending licence plate can be taken. An in-ground sensor 74 with a digital camera, or a separate in-ground or wall-mounted camera 51 can be signalled to take a photo of the offending licence plate, or a mobile camera on the lot can be moved to focus on the violating stall.

While a number of exemplary aspects and embodiments have been discussed above, those of skill in the art will recognize certain modifications, permutations, additions and sub-combinations thereof. While wireless communication between the vehicle sensors, digital cameras and central processor is preferred, the system could also be wired for communication.

What is claimed is:

1. A method of vehicle parking control and enforcement in respect of a plurality of unmetered parking spaces, said method comprising:

a) providing a plurality of in-ground sensors in spaced in-ground locations in said unmetered parking spaces, each in-ground sensor associated with a related parking space and comprising a vehicle sensing element, a microprocessor, a clock and a timer coupled with and controlled by the microprocessor, a memory communicating with the microprocessor and containing parking information, including parking rules, respecting said related parking space, and wireless communication means coupled to the microprocessor;

b) upon one of said in-ground sensors sensing the presence of a vehicle in a parking space, communicating the presence of the vehicle in said related parking space to said microprocessor;

c) said microprocessor starting the timing of a parking period for said related parking space based on said parking rules;

d) if said parking information provides that said related parking space is a no-parking space at the time said vehicle was sensed, wirelessly communicating a violation signal to a parking authority if said vehicle is still sensed in said related parking space after a pre-determined standby interval from when said vehicle was sensed;

e) if said parking information provides that said related parking space is a time-limited parking space for a specified duration at the time said vehicle was sensed, continuing to time the elapsed parking time until said microprocessor receives a signal from said in-ground sensor that said vehicle has left said related parking space, or until said specified duration has expired; and f) if said vehicle is still in said related parking space after said specified duration has expired, wirelessly communicating a violation signal to a parking authority.

2. The method of claim 1 comprising the further steps of g) providing a digital camera; h) taking a digital image of the license plate of said vehicle if a violation is detected; and i) communicating said digital image of the license plate of said vehicle to the parking authority.

3. The method of claim 2 wherein said digital camera is mounted above ground and separately from said in-ground sensor and receives a signal from said in-ground sensor to initiate said taking of said digital image of the license plate of said vehicle.

4. The method of claim 3 wherein two digital cameras are provided on said in-ground sensor and said communication step is done wirelessly from said in-ground sensor.

5. The method of claim 3 wherein an infrared light is provided on said in-ground sensor.

6. The method of claim 2 wherein said digital camera is provided on said in-ground sensor and said communication step is done wirelessly from said in-ground sensor.

7. The method of claim 6 wherein two adjacent in-ground sensors comprising digital cameras are provided and the first in-ground sensor which has detected a violation communicates wirelessly with the second adjacent in-ground sensor to take a digital image of the license plate of said vehicle.

8. The method of claim 7 wherein if both of said adjacent in-ground sensors detect vehicles the taking of a digital image is delayed until one of the related parking spaces is vacated.

9. The method of claim 1 or 2 wherein said parking authority is a mobile device provided with a digital camera for taking a digital image of the license plate of said vehicle.

10. The method of claim 1 wherein each said relaxed parking space is marked with an identifying number and said parking authority comprises a display visible to said plurality of parking spaces whereby when a violation is indicated the identifying number associated with the related parking space occupied by the violating vehicle is displayed on said display.

11. A method of vehicle parking control and enforcement in respect of a plurality of =metered parking spaces, said method comprising:

a) providing a plurality of in-ground sensors in spaced in-ground locations in said unmetered parking spaces, each in-ground sensor associated with a related parking space and comprising a vehicle sensing element, a microprocessor, a memory communicating with the microprocessor and containing parking information respecting said related parking space, namely the electronic identification of the vehicle authorized to park in said related space and wireless communication means coupled to the microprocessor;

b) providing each vehicle authorized to park in one of said related parking spaces with an electronic tag readable by said in-ground sensor and containing said electronic identification;

c) one of said in-ground sensors sensing the presence of a vehicle in a parking space, said in-ground sensor detecting said electronic identification of said vehicle and comparing said electronic identification of said vehicle to said parking information stored in said memory; and d) if said electronic identification of said vehicle differs from said parking information stored in said memory, or said vehicle has no electronic identification, wirelessly communicating a violation signal to a parking authority.

12. A system for vehicle parking control and enforcement in respect of a plurality of unmetered parking spaces, comprising:

a) a plurality of unmetered parking spaces;

b) a plurality of in-ground sensors in spaced in-ground locations in said unmetered parking spaces, each in-ground sensor associated with a related parking space and comprising a vehicle sensing element, a microprocessor, a clock and a timer coupled with and controlled by the microprocessor, a memory communicating with the microprocessor and containing parking information respecting said related parking space, and wireless communication means coupled to the microprocessor; and c) means provided in said microprocessor for:

i) upon receiving from one of said in-ground sensors a signal indicating the presence of a vehicle in a parking space;

ii) starting the timing of a parking period for said related parking space based on said parking information;

iii) if said parking information provides that said related parking space is a no-parking space at the time said vehicle was sensed, wirelessly communicating a violation signal to a parking authority if said vehicle is still sensed in said related parking space after a predetermined standby interval from when said vehicle was sensed;

iv) if said parking information provides that said related parking space is a time-limited parking space for a specified duration at the time said vehicle was sensed, continuing to time the elapsed parking time until said microprocessor receives a signal from said in-ground sensor that said vehicle has left said related parking space, or until said specified duration has expired; and v) if said vehicle is still in said related parking space after said specified duration has expired, wirelessly communicating a violation signal to a parking authority.

13. The system of claim 12, wherein each of the in-ground sensors includes a digital camera for taking a digital image of the license plate of said vehicle if a violation is detected and communicating said digital image of the license plate of said vehicle to the parking authority, each camera being integrally formed with its respective one of the in-ground sensors.

* * * * *

UNITED STATES PATENT AND TRADEMARK OFFICE

CERTIFICATE OF CORRECTION

PATENT NO. : 8,487,754 B2
APPLICATION NO. : 12/529147
DATED : July 16, 2013
INVENTOR(S) : Frederick L. Mitschele It is certified that error appears in the above-identified patent and that said Letters Patent is hereby corrected as shown below:

In the Claims

Col. 7, Lines 10-37, delete claim 11 and insert in its place

--11. A method of vehicle parking control and enforcement in respect of a plurality or unmetered parking spaces, said method comprising:

a) providing a plurality of in-ground sensors in spaced in-ground locations in said unmetered parking spaces, each in-ground sensor associated with a related parking space and comprising a vehicle sensing element, a microprocessor, a memory communicating with the microprocessor and containing parking information respecting said related parking space, namely the electronic identification of the vehicle authorized to park in said related space and wireless communication means coupled to the microprocessor;

b) providing each vehicle authorized to park in one of said related parking spaces with an electronic tag readable by said in-ground sensor and containing said electronic identification;

c) one of said in-ground sensors sensing the presence of a vehicle in a parking space, said in-ground sensor detecting said electronic identification of said vehicle and comparing said electronic identification of said vehicle to said parking information stored in said memory; and d) if said electronic identification of said vehicle differs from said parking information stored in said memory, or said vehicle has no electronic identification, wirelessly communicating a violation signal to a parking authority.--

Signed and Sealed this
Seventeenth Day of September, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,487,754 B2
APPLICATION NO. : 12/529147
DATED : July 16, 2013
INVENTOR(S) : Frederick L. Mitschele It is certified that error appears in the above-identified patent and that said Letters Patent is hereby corrected as shown below:

In the Claims

Col. 7, Lines 10-37, delete claim 11 and insert in its place

--11. A method of vehicle parking control and enforcement in respect of a plurality "of" unmetered parking spaces, said method comprising:

a) providing a plurality of in-ground sensors in spaced in-ground locations in said unmetered parking spaces, each in-ground sensor associated with a related parking space and comprising a vehicle sensing element, a microprocessor, a memory communicating with the microprocessor and containing parking information respecting said related parking space, namely the electronic identification of the vehicle authorized to park in said related space and wireless communication means coupled to the microprocessor;

b) providing each vehicle authorized to park in one of said related parking spaces with an electronic tag readable by said in-ground sensor and containing said electronic identification;

c) one of said in-ground sensors sensing the presence of a vehicle in a parking space, said in-ground sensor detecting said electronic identification of said vehicle and comparing said electronic identification of said vehicle to said parking information stored in said memory; and d) if said electronic identification of said vehicle differs from said parking information stored in said memory, or said vehicle has no electronic identification, wirelessly communicating a violation signal to a parking authority.--

This certificate supersedes the Certificate of Correction issued September 17, 2013.

Signed and Sealed this
Fourth Day of February, 2014

Michelle K. Lee

Michelle K. Lee
*Deputy Director of the United States Patent and Trademark Office*